US005194887A

United States Patent [19]

Farling et al.

[11] Patent Number: 5,194,887

[45] Date of Patent: Mar. 16, 1993

[54] APPARATUS FOR TESTING PHOTOGRAPHIC EMULSIONS

[75] Inventors: Duane J. Farling, Webster; James E. Novak, Greece, both of N.Y.

[73] Assignee: Eastman Kodak Company, Rochester, N.Y.

[21] Appl. No.: 823,920

[22] Filed: Jan. 22, 1992

[51] Int. Cl.[5] ..... G03D 13/00

[52] U.S. Cl. ..... 354/297; 354/299; 354/324

[58] Field of Search ..... 355/38, 68, 77, 27; 354/297, 298, 299, 324

[56] References Cited

U.S. PATENT DOCUMENTS

| | | | |
|---|---|---|---|
| 3,995,959 | 12/1976 | Shaber | 356/202 |
| 4,128,325 | 12/1978 | Melander et al. | 354/298 |
| 4,365,895 | 12/1982 | Shaber | 356/444 |
| 4,415,610 | 11/1983 | Choinski | 427/372.2 |
| 4,464,036 | 8/1984 | Taniguchi et al. | 354/324 |
| 4,527,878 | 7/1985 | Taniguchi et al. | 354/298 |
| 4,611,918 | 9/1986 | Nishida et al. | 356/404 |
| 4,985,320 | 1/1991 | Griffin | 430/30 |
| 5,083,152 | 1/1992 | Tokuda | 355/27 |

*Primary Examiner*—Michael L. Gellner
*Assistant Examiner*—D. Rutledge
*Attorney, Agent, or Firm*—Heslin & Rothenberg

[57] ABSTRACT

An apparatus for determining the sensitometric characteristics of a photographic emulsion is disclosed. The emulsion to be tested may be in its fluid state or it may be a solid or semi-solid disposed on a substrate. The apparatus can mix, spread, set, dry and incubate a photographic emulsion, then expose, develop and evaluate the emulsion in an integrated, single operation.

16 Claims, 9 Drawing Sheets

APPARATUS FOR TESTING PHOTOGRAPHIC EMULSIONS

CROSS REFERENCE TO RELATED APPLICATIONS

This application contains subject matter in common with U.S. applications entitled "Microwave-Heated Film Processing Apparatus" and "Single Unit Apparatus For Chilling, Drying and Incubating Photographic Emulsions" filed on even date herewith.

BACKGROUND OF THE INVENTION

1. Field of the Invention

The present invention relates to an apparatus for determining the sensitometric characteristics of a photographic emulsion. The emulsion to be tested may be in its fluid state or it may be a solid or semi-solid disposed on a substrate.

2. Background Art

The commercial production of photographic film involves the preparation of very large batches, on the order of 1500 L, of chemically complex photographic emulsions whose batch-to-batch variation in photographic response must be kept to a minimum. The photographic characteristics of an emulsion (contrast, speed, reciprocity, maximum density and fog) are commonly referred to as its sensitometric properties. Currently sensitometric properties are assayed on each batch of emulsion by actually running a portion of the emulsion through the commercial scale coating machinery to provide a section of coated web, exposing the emulsion in a controlled fashion in a sensitometer, developing the image by conventional processing bath technology, and measuring the image in a densitometer. This assay method is very time-consuming, wastes large amounts of materials, yields data slowly and is almost completely inflexible to changing parameters.

An example of an apparatus that coats and cures an emulsion on a scale that can be used for testing is given in U.S. Pat. No. 4,415,610 (Choinski) which discloses a coating system incorporating a chilling zone simulator and a drying zone simulator. The coating system is preferably adapted to coat relatively short lengths of web, and to be cleaned and recharged rapidly with different compositions for coating another short section of web. Means are provided for stopping a coated length of web in the chill zone simulator. The chilled web is then rapidly advanced into a drying zone simulator, where the web is again stopped. After the desired sequence of drying cycles is completed, the dried web is rapidly advanced to a sampling section in which a relatively short section of dried coated web may be cut off for testing.

The art provides several examples of apparatus that can be used to assess various sensitometric properties of emulsions when the emulsion is supplied already coated on a web. In some cases the developing process is carried out separately, and in others the developing process is carried out on commercial scale equipment that offers virtually no provision for modulating temperature or process chemistry in response to changing emulsions.

U.S. Pat. No. 4,365,895 (Shaber et al.) discloses an apparatus for evaluating an X-ray film processor. The disclosure specifically relates to a densitometer and the circuitry and logic necessary for the densitometer to provide information which can be used by an operator to assess the operational status of a film processor. There is no teaching with regard to developing or transporting the material being tested from an exposure location to densitometer.

U S. Pat. No. 4,464,036 (Taniguchi et al.) discloses an apparatus for controlling the activity of a photographic developing solution. A difference is obtained between a standard optical density and a test optical density, both measured at a certain point in a developing process. The difference is used to drive a corrective action: either adding an appropriate amount of supplementary solution or putting an exposed film into the developing solution.

U.S. Pat. No. 4,527,878 (Taniguchi et al.) discloses an apparatus very similar to that in U.S. Pat. No. 4,464,036 for an analogous correction in developing baths.

U.S. Pat. No. 3,995,959 (Shaber) discloses a densitometer coupled to a logic circuit the output of which produces a diagnostic indication of whether the chemistry of the film processor from which the test strip was derived is within acceptable limits. The only transport of the test substrate is a calibrated movement through the densitometer.

U.S. Pat. No. 4,611,918 (Nishida et al.) discloses a method for determining the optimum exposure conditions for a photographic color printer. The method is performed by preparing a plurality of test prints under different exposure conditions using a standard negative film, measuring optical density for each of the color components on the test prints, comparing their optical density with that of the corresponding color component on a standard print, detecting a change in optical density per unit positional change of correction key on each of the test prints with respect to each of the color components, and determining corrective value required for correcting the density difference between each of test prints and a standard print with reference to the change in optical density per unit positional change of correction key. The test procedure is illustrated as integrated into a standard color printer which has a developing section and a drying section through which the print is moved. The developing and drying time are modulated in a fixed ratio by the speed of transport of the paper. The chemistry of the developing bath is determined by the composition with which the bath is filled at the start of processing.

U.S. Pat. No. 4,128,325 (Melander et al.) discloses an automatic calibration system for use in a replenishment system for a processor of photosensitive material. The invention includes a sensing means which senses when photosensitive material approaches a density sensor. When photosensitive material is sensed approaching the density sensor, a calibration means monitors the signal from the density sensor and provides a calibration signal which automatically calibrates the density sensor. This calibration is performed before the photosensitive material reaches the density sensor.

U.S. Pat. No. 4,985,320 (Griffin) discloses a method and apparatus for controlling replenishment chemistry in a photographic film processor. It includes a calibration circuit using a light source and a photodetector and having one or more predetermined density values located on a reference control strip, the location thereof being used for comparative purposes with the location of equivalent density value on a developer test control strip. The quantified difference between the measured and reference location is used to control automatically the film replenishment chemistry.

None of the references discloses a system wherein the developing conditions can be modified in a programmable fashion so that the sensitometric properties of the various emulsions can be evaluated. The art addresses itself to systems for evaluating and, in some cases, adjusting large scale processes for developing film or prints. (Throughout the application the term "develop" will be used in place of the more technically accepted term "process" when confusion can be avoided thereby.) In all cases where the evaluation apparatus is a part of an apparatus for processing a photosensitive material, the developing process is carried out in a standard bath or baths through which the photosensitive material is drawn. In such a system, changing the parameters of the developing process in response to a change in the fundamental chemistry of a different photographic emulsion may require many hours, often a whole work day. The bath must be emptied, cleaned and refilled with a large volume of often expensive chemicals; the temperature must be equilibrated; the path length or speed of transport must be modified. If the developing process requires sequential exposure to multiple processing chemicals, the problem increases geometrically. There thus exists a need for an apparatus which can evaluate test batches of differing photographic emulsions on a web by exposing them, processing them and measuring their sensitivity in a practical time frame.

Photographic emulsions are prepared commercially in large batches. While the chemical characteristics of a batch can be monitored on an aliquot of the batch, there has heretofore been no convenient way to assay the sensitometric properties of a small aliquot of emulsion. There is thus a need for an apparatus that can coat a web with an aliquot of an emulsion, cure the emulsion, and then evaluate the sensitivity of the emulsion.

SUMMARY OF THE INVENTION

It is an object of the present invention to provide an apparatus that can process differing photographic emulsions and evaluate their sensitivity in a practical time frame and using minimal quantities of chemicals.

It is a further object of the invention to provide an apparatus that can set, dry and incubate differing photographic emulsions, then process them and evaluate their sensitometric properties.

It is a further object of the invention to provide an apparatus that can mix, spread, set, dry and incubate a photographic emulsion, then expose, develop and evaluate the emulsion.

The invention in its basic form, relates to an apparatus for testing the sensitivity (contrast, speed, reciprocity, maximum density and fog) of a photographic emulsion. The apparatus comprises:

(a) means for exposing a web coated with a photographic emulsion with a known image;

(b) means for developing the emulsion on the web, the developing means being capable of control as to developer chemical composition, time and temperature;

(c) densitometer means for measuring the optical density of the developed, known image on the web;

(d) transport means for transporting the web coated with the emulsion from the exposing means to the densitometer means through the developing means;

(e) first control means for controlling the time, temperature and chemistry of the developing means; and (f) second control means for regulating the progress of the web from the exposing means to the densitometer means.

In a further aspect, the invention relates to an apparatus for testing the sensitivity of a photographic emulsion which additionally incorporates data analyzing means for analyzing and displaying the output of the densitometer.

In a further aspect, the invention relates to an apparatus as described above further incorporating an emulsion chilling, drying and incubating means and the controlling means therefor.

In a further aspect, the invention relates to an apparatus as described above additionally incorporating an emulsion spreading means and controlling means therefor. The spreading means is located so as to feed a web coated with emulsion to the chilling, drying and incubating means.

In a further aspect, the invention relates to an apparatus as described above additionally incorporating an emulsion preparing means and controlling means therefor. The preparing means feeds the spreading means.

In a further aspect, the invention relates to an apparatus as described above, either in its basic form or any of its expanded forms, additionally incorporating drying means interposed between the developing means and the densitometer.

In a further aspect, the invention relates to an apparatus having spreading, curing, exposing, densitometer, transport and control means as described above, but with a traditional developing station of the constant temperature bath type in place of the modifiable developing station in which the processing time, temperature and chemistry can be controlled.

DESCRIPTION OF PREFERRED EMBODIMENTS

The apparatus of the invention is designed to enable an operator to evaluate on a single machine the sensitometric properties of any photographic emulsion that the operator is presented with. Before the present invention this was impractical because photographic emulsions vary widely in their requirements for preparation, curing (chilling, drying and incubating) and developing. With the present apparatus an emulsion may be mixed, spread, cured and evaluated in one operation.

Figure 1:
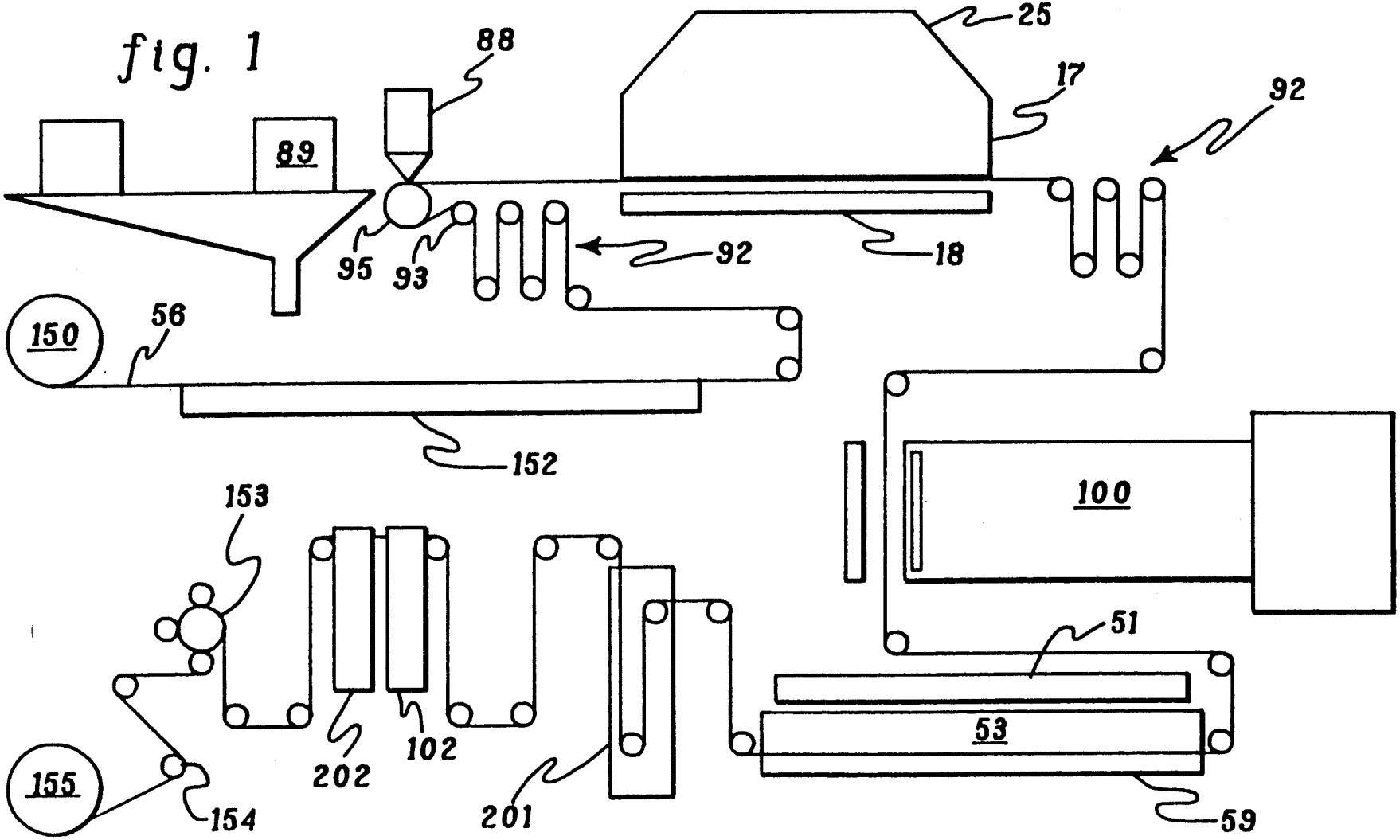
FIG. 1 is a schematic vertical sectional view of an apparatus that prepares, spreads, sets, dries, and incubates a photographic emulsion on a web and exposes, develops and measures the sensitivity of the emulsion in one process.

FIG. 1 provides an overall schematic view of an embodiment of the apparatus, including several optional features to be described below. A web 56 is transported via a main drive 153 from an unwind reel 150 to a rewind reel 155 under the control of a computer (not shown). Exemplary materials used for the webs are cellulose acetate, polyester films such as Estar TM or Mylar TM, and photographic paper. The web 56 is coated with an emulsion 89 by a spreader comprising a hopper 88 and a coating drive 95. Local control of the web velocity is provided by accumulators 92 acting in concert with the coating drive 95. The emulsion is cured in a drying and incubating chamber comprising platen 18, walls 17 and top 25. The web coated with cured emulsion is exposed with a known image in sensitometer 100 and developed in a developing system comprising upper 53 and lower 59 platens and a set of pneumatic cylinders 51. Optionally the web passes through a dryer 201, before arriving at a first densitometer 102. A second, optional densitometer 202 may be interposed before rewind reel 155. The apparatus may also comprise an optional web splicing station 152 which allows the operator to insert pieces of precoated web into the continuous web 56. FIGS. 2 to 6 and 9 illustrate subsystems in further detail.

Figure 2:
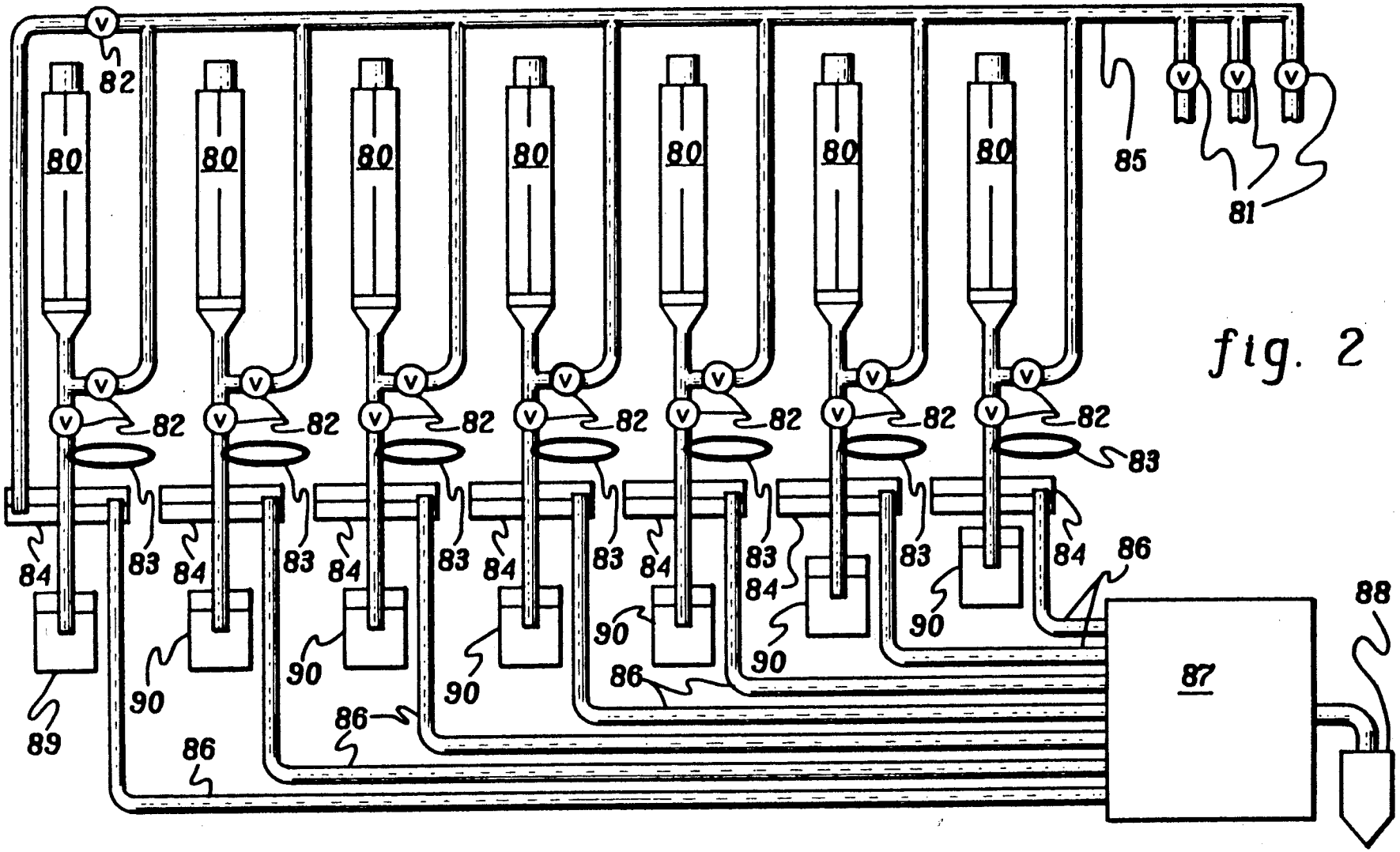
FIG. 2 is a schematic of that portion of the apparatus of the invention that prepares an emulsion.

Various chemical constituents of an emulsion are stored in reservoirs and can be delivered to a mixing chamber as shown in FIG. 2. Under normal circumstances hardeners and surfactants may be added to the emulsion immediately before coating. In special cases where the emulsion requires more extensive modification for testing, photoactive components, gels, and diluents may be added as well to achieve the proper balance of optical density for testing and viscosity for coating. The reagents are preferably stored in reservoirs 90 at slightly elevated temperature, but may be heated or cooled as needed, and are delivered by syringe pumps 80 and valves 81, 82 and 84 which are controlled by a microprocessor (not shown) in a manner well known in the art. As can be seen in FIG. 2, each syringe 80 is protected by a storage loop 83 having slightly greater capacity than the syringe. In this fashion, the loops are cleaned by the delivery solvent, and the syringes remain uncontaminated. Each reagent is delivered through a supply line 86 to a mixing chamber 87.

Figure 3:
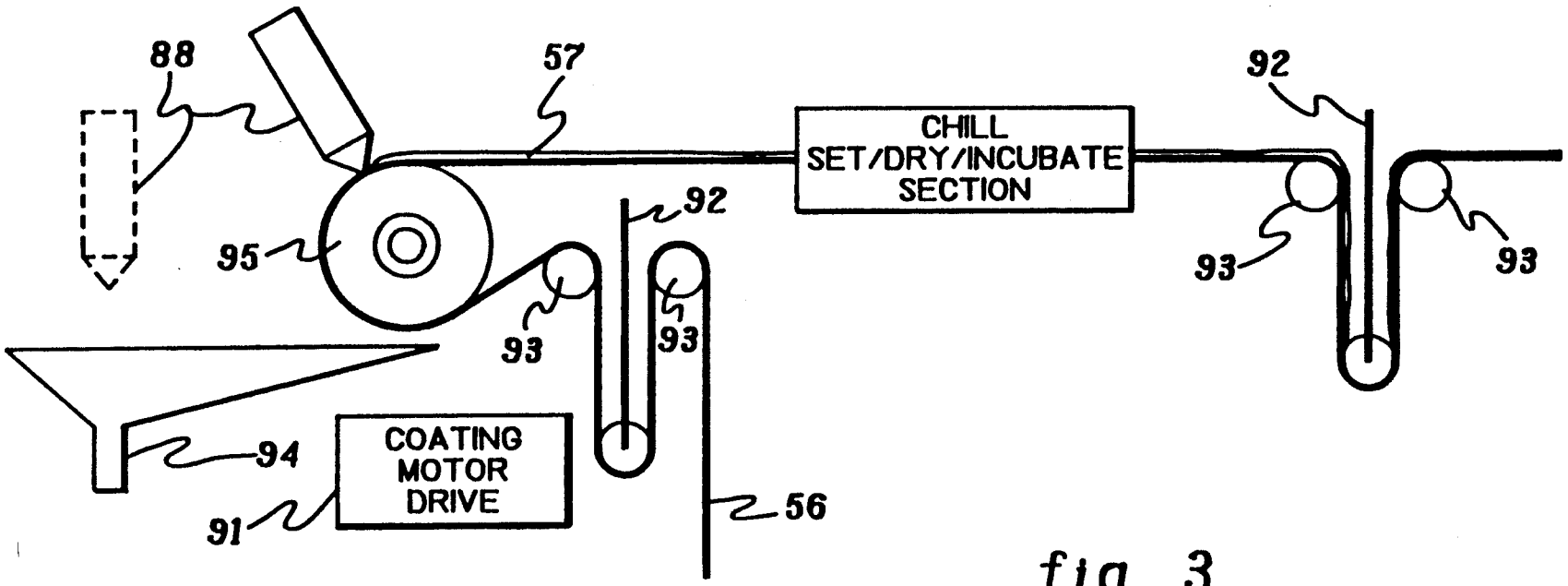
FIG. 3 is a schematic of that portion of the apparatus of the invention that coats an emulsion onto a web.

The emulsion is delivered to a standard hopper 88 of the type well known in the art, and spread on an appropriate web as shown in FIG. 3. Because the spreading process requires extremely precise control of web velocity, it is advantageous to employ a series of accumulators 92 to allow the coating drive 95 to control the local web velocity.

Figure 4:
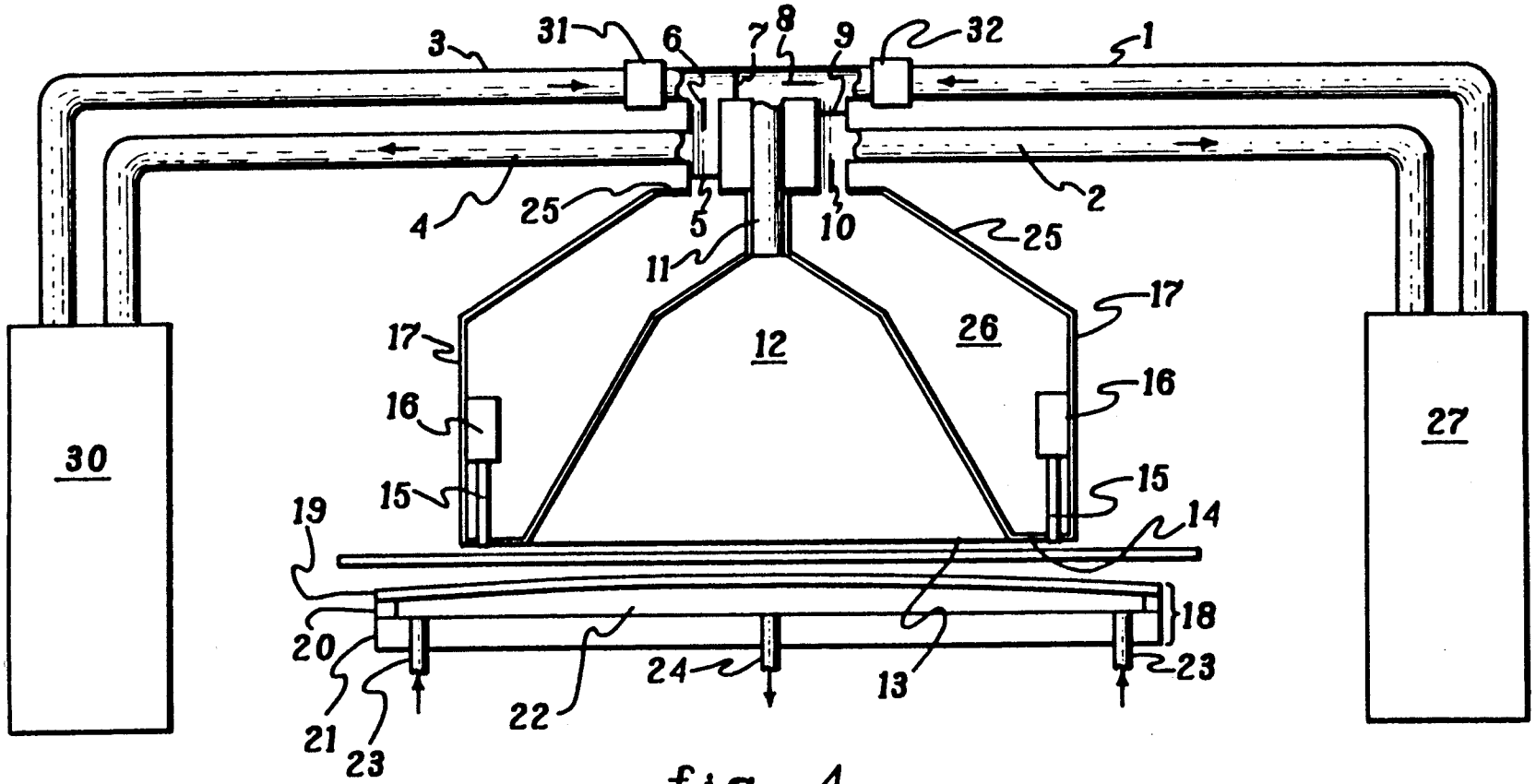
FIG. 4 is a schematic of that portion of the apparatus of the invention that chills, dries and incubates the emulsion.

From the spreader, the web, with the emulsion thereon, passes to a chiller, drier and incubator, shown in FIG. 4. In operation, the web, at the start of the process, passes over the platen 18 but is not in contact with the platen 18 or the chamber walls 17. Chilled heat exchanging fluid, preferably water, of a temperature appropriate to set the gel in the emulsion of interest, is passed through a pair of orifices 23 formed in a platen support block 21 into a cavity 22 formed by the platen face plate 19, a gasket 20 and the support block 21. The heat exchange fluid is led out of the cavity through a central orifice 24. The platen face plate 19 may be constructed of any material that is thermally conductive and inert to the environment to which it will be exposed. The surface of the platen face plate is as smooth as possible for optimum heat transfer and is slightly arched in the longer dimension of the web so that contact with the web will be uniform when the web is held against the ends of the platen. The platen face plate 19 is thick enough to provide support for the web over its entire surface but no thicker than necessitated by mechanical requirements so as to minimize thermal inertia. It has been found that 1.27 mm stainless steel or preferably copper plated on its contact surface with chromium provides a suitable platen face plate. The gasket 20 is, in the preferred embodiment, about 13 mm thick and of any resilient water-resistant material. The plate support block 21 is preferably made of plastic or similar inert, mechanically stable, insulating material.

When the platen has reached a prescribed temperature, a pair of pneumatic cylinders 16 are activated and the urging members 15 are displaced downward against the surface of the web. The urging members are preferably of substantially the same or slightly greater width than the width of the platen. The movement of the urging members forces the web against the platen face plate 19. This configuration is maintained until the gel has set according to a prescribed combination of time and temperature appropriate to the specific emulsion being cured.

When the gel has set, dampers 8, 10 and 6 are opened; dampers 9, 5 and 7 are closed. Drying air is led into the chamber through duct 1 past damper 8 to a distributing manifold 12. Most efficient distribution of the drying air is achieved when the cross-sectional area of the orifice 13 on the face of the distribution manifold 12 is smaller than the cross-sectional area of the duct 1. The air passes laterally across the width of the emulsion and returns via a return manifold 26 past damper 10 to return duct 2.

When the emulsion has been dried for the appropriate length of time, dampers 8, 10 and 6 are closed and dampers 9, 5 and 7 are opened. Incubation air is led into the chamber through duct 3, past damper 7 into distribution manifold 12, across the emulsion and back through return manifold 26, past damper 5 to return duct 4.

At an appropriate time in the cycle, the heat transfer fluid which has been cooling the platen 18 is switched to provide heating of the platen. After a prescribed period of heating the platen and passing incubating air over the emulsion, the pneumatic cylinders 16 are deactivated, the urging members 15 are retracted upward and the web is released.

If the operator has a web already containing a prepared emulsion that is desired to be evaluated, it can be spliced into the web on the apparatus, and the mixing, spreading and curing processes may be bypassed, or, if not bypassed, an additional layer may be laid down on top of the introduced emulsion layer.

The web containing the cured emulsion is transported to an exposure means, typically a sensitometer, employing a light source, filters and a step wedge as known in the art. A detailed description of a preferred embodiment of a sensitometer is available in U.S. Pat. Nos. 4,894,683; 4,922,089 and 4,947,207. The emulsion is exposed for an appropriate period to light of a specified intensity, wavelength and pattern. The wavelength and intensity may be adjusted by appropriate filters and the use of various light sources (tungsten, xenon etc.). The pattern is most conveniently provided by a step wedge. If the emulsion to be tested is a color sensitive emulsion, the exposure pattern is somewhat more complex than black and white, employing a 21-step, 4-color wedge in place of a single 21-step wedge. The technology of density-calibrated exposure is well known in the art.

Figure 5:
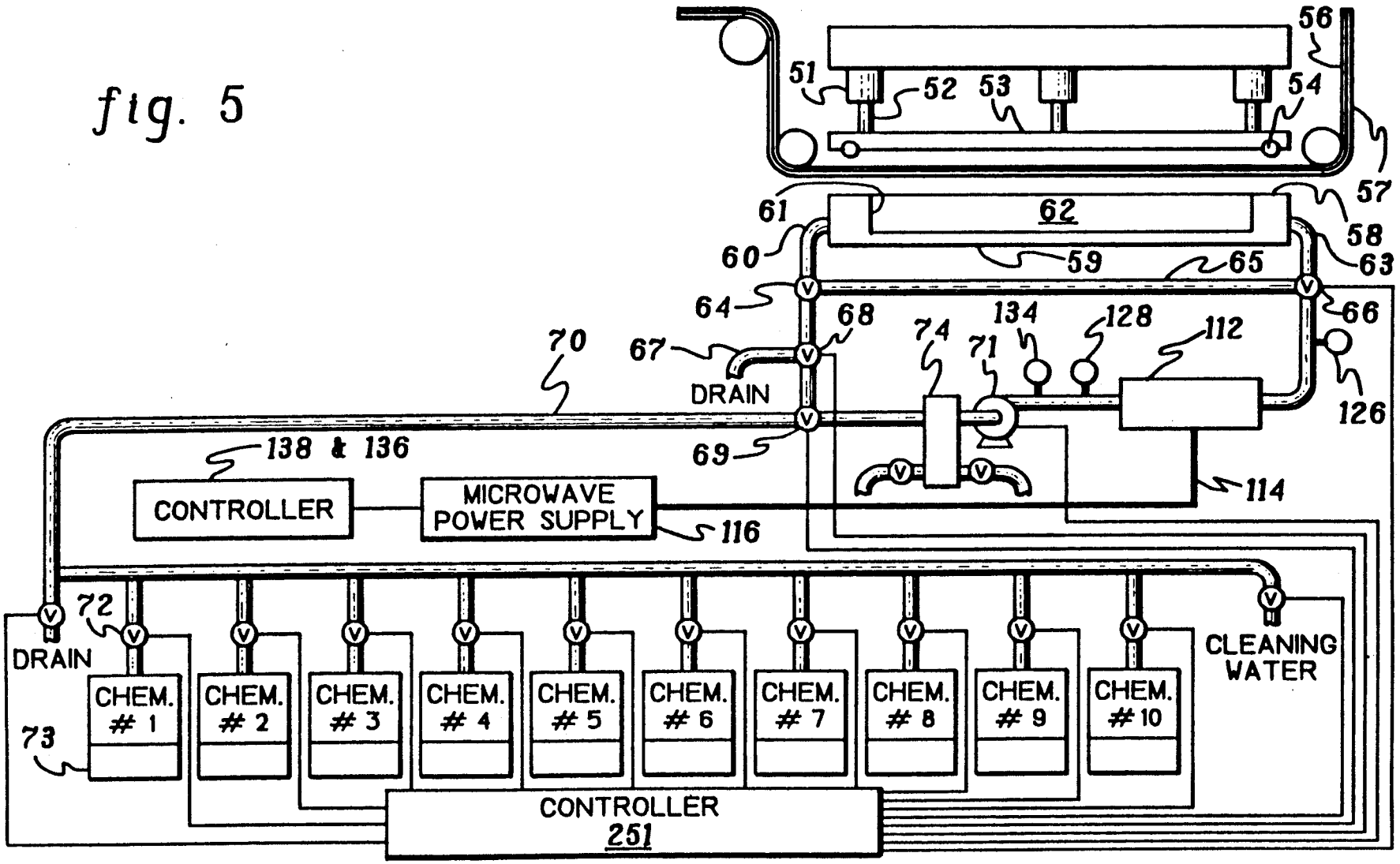
FIG. 5 is a schematic of that portion of the apparatus of the invention that processes the emulsion.
Figure 6:
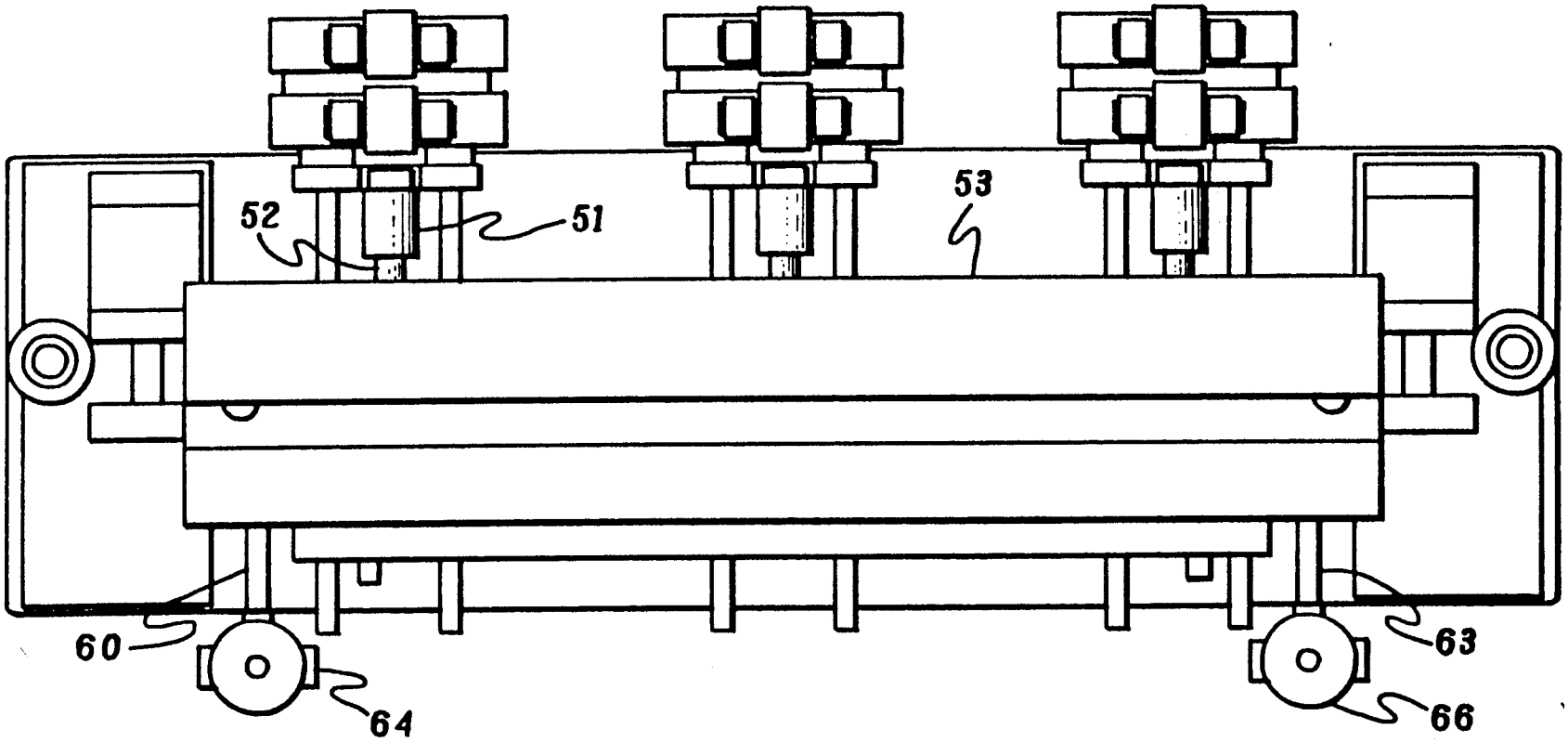
FIG. 6 is a more detailed schematic of the processing station.

After exposure, the web passes to a processing station, FIG. 5.

The web 56, coated on one face with a photosensitive material 57 passes between two platens 53 and 59. The platens may be of any material or combination of materials that is thermally insulating and mechanically stable under the forces necessary to provide a seal between the photosensitive material 57 and the lower platen 59. A block of PTFE (Teflon TM) or a metal block having enough thickness of PTFE to function as an insulator can be used. Other polymers may also be used in place of PTFE, but the range of chemicals to which they may be exposed is narrower. The platens are shown in somewhat more detail in FIG. 6.

In operation the pneumatic cylinders 51 acting on the shafts 52 displace platen 53 downward, forcing web 56 and coating 57 against the face of platen 59. A raised, resilient pattern 54, which is smaller than platen 59 but marginally larger than cavity 61, provides a localized pressure on the web just outside or at the perimeter of the cavity 61 to create a seal between the photosensitive material 57 and the platen face 58. The raised, resilient pattern is preferably provided by an O-ring or gasket 54 fitted in a corresponding channel 55 in platen 53.

Once a seal has been made, defining a chamber 62, a processing fluid is drawn by pump 71 from a supply line 70, pumped past flow detector 134 and temperature detector 128 through microwave cavity 112, past temperature detector 126 through duct 63 and into processing chamber 62. The fluid passes through the chamber 62, out through duct 60 and valve 68 to drain 67. An optional, but preferred, additional loop including valves 64 and 66 and shunt 65 allows bypass of the chamber when additional temperature control is desired. Thus valves 68 and 69 may be opened to drain 67 and supply 70 respectively, valves 64 and 66 set toward shunt 65 and fluid pumped from supply 70 to drain 67. Valves 68 and 69 are then set for internal cycling and fluid is pumped in a loop through the microwave cavity 112 and the shunt 65 until it is ready for use. When the temperature is within desired limits, valves 64 and 66 are set towards ducts 60 and 63 and fluid is pumped in a loop through chamber 62. When the appropriate time and volume has been reached, valves 68 and 69 are reset for supply 70 and drain 67 and the chamber 62 flushed with a second fluid, commonly a wash. This cycle is repeated with or without the involvement of the shunt 65 for each successive processing fluid. A single liquid, usually referred to as a monobath, can be used to develop the latent image on the emulsion, or developer and fixer solutions, as well as water, or various processing fluids can be introduced from reservoirs 73 sequentially into the apparatus by controlling valves 72. The term "processing fluid" is meant to include all of these. The terms "process", "develop", "processing", "developing", etc. are considered to be synonymous as used throughout the specification and claims.

Figure 9:
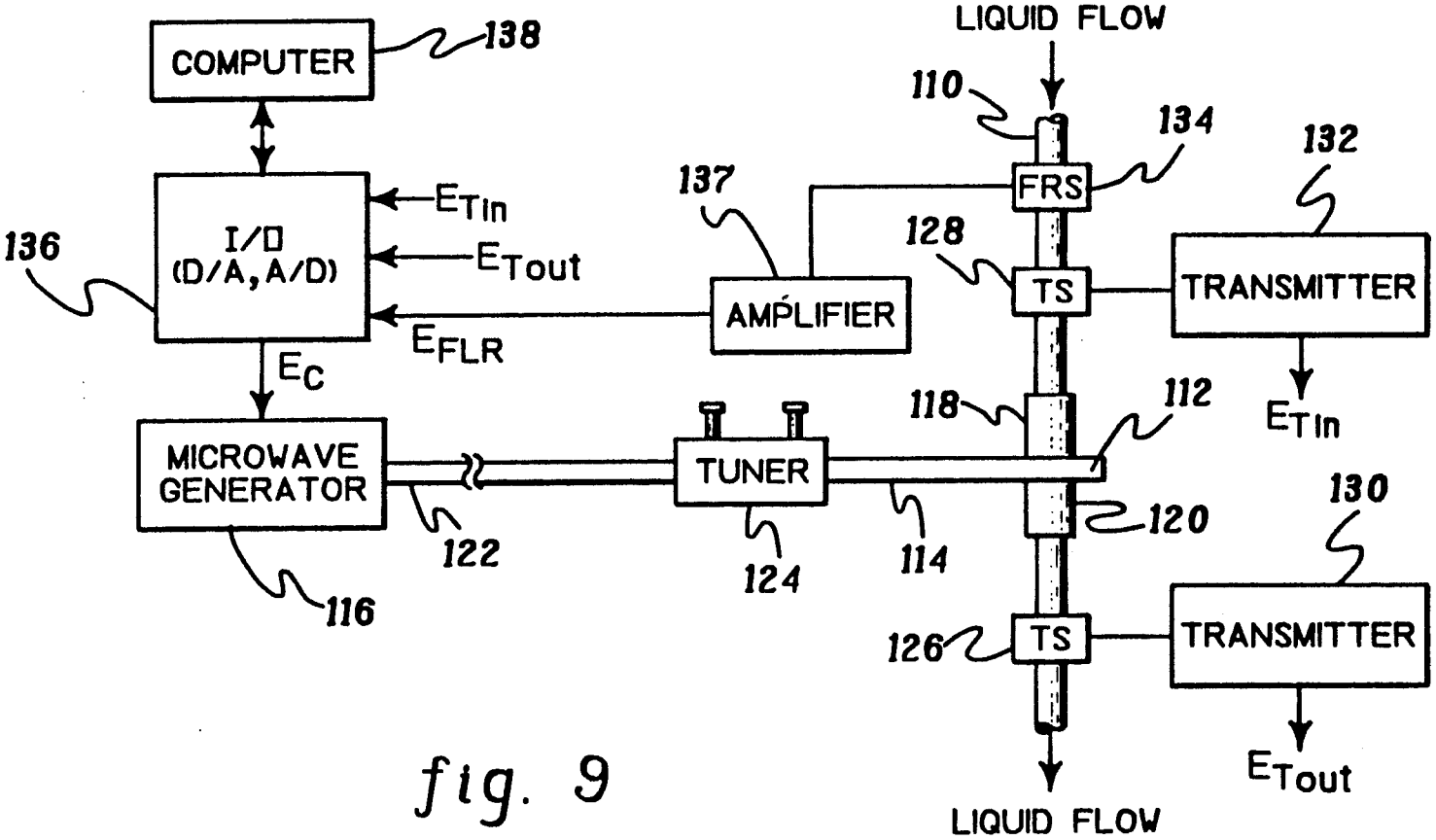
FIG. 9 is a schematic diagram of the heating element of a preferred embodiment of the invention that utilizes a microwave energy source.

The configuration of the microwave heater is shown in FIG. 9 in somewhat more detail. Referring to that figure, the processing fluid flows through a plastic pipe 110 past a temperature control point 112 in a wave guide applicator section 114, which applies microwave energy from a microwave generator 116 to heat the fluid at the control point. Conductive couplings 118 and 120 are used to seal the applicator 114 against the escape of microwave energy. The plastic pipe 110 carrying the fluid extends through these couplings.

The applicator 114 is tuned to the frequency of the microwave generator. For example, a suitable generator is made by Gerling Laboratories of Modesto, Calif., USA and produces an output frequency of 2.45GHz. Other frequencies may be used, for example, when larger waveguides are practical. The microwaves are transmitted by a wave guide 122 to the applicator 114. The applicator 114 is tuned by a slug tuner 124. Such tuners are shown in U.S. Pat. No. 4,689,459. The microwave generator is controlled by a control signal (for example, a voltage which may vary from 0 to 1 volt) which changes the microwave energy supplied to the applicator 114 from 0 to 3 KW.

The temperature of the incoming fluid is measured ahead of the control point and also after the control point 112 by temperature sensors 128 and 126, which are close enough to the control point that time delay between temperature measurements is minimal and the temperature at the sensor 126 is substantially the same as the temperature of the fluid at the control point. Thermistors which are responsive to the temperature of the liquid in the pipe are suitable sensors. A heat exchanger 74, supplied with chilled water, is interposed ahead of the pump 71 to ensure that the fluid will always be at a temperature lower than desired when it enters the microwave heater 114. The transmitters 130 and 132 also contain amplifiers which produce analog outputs, for example, currents (e.g. from 4 to 20 mA) proportional to the temperature measured by the thermistors 128 and 126. These analog outputs are indicated as $E_{Tin}$ and $E_{Tout}$.

A flow sensor 134 (FRS) is also disposed to sense the flow rate of the liquid through the pipe 110. The output of the sensor 134 is amplified in an amplifier 137 and produces the flow rate signal, $E_{FLR}$, which may also be a 4 to 20 ma current signal.

The signals $E_{Tin}$, $E_{Tout}$ and $E_{FLR}$ are applied to an input output (I/O) device 136, including analog to digital converters which digitize these signals, iteratively at a sampling rate, which may be at one second intervals. The digital signals are applied by the I/O 136 to a digital computer 138 which implements the control system. The computer communicates through the I/O 136 with the microwave generator and provides the control signal $E_c$. This control signal is an analog signal, which as indicated above may vary between 0 and 1 volt. The microwave generator has suitable amplifiers which use this control signal $E_c$ to control a magnetron therein which produces the microwave energy. A digital to analog converter in the I/O 136 provides the analog control signal $E_c$ to the microwave generator 116. The I/O 136 includes memory (e.g., latches and other digital logic) for holding the output signals between sampling times. The computer 38 which implements the control system is preferably of the type suitable for real time multi-tasking operation (e.g., the Hewlett Packard 1000 Series 360 or similar process control computer). This computer is programmed to carry out the processes or algorithms needed.

After processing, the web passes to the densitometer, where the optical density of the test pattern is read. The construction and operation of densitometers is well known in the art. Typical densitometers that may be employed are available from MacBeth (Newburgh, N.Y.) and X-rite Inc. (Grandville, Mich.). The signal from the densitometer is fed to a computer which stores and displays the output according to the instructions of the operator.

Figure 7:
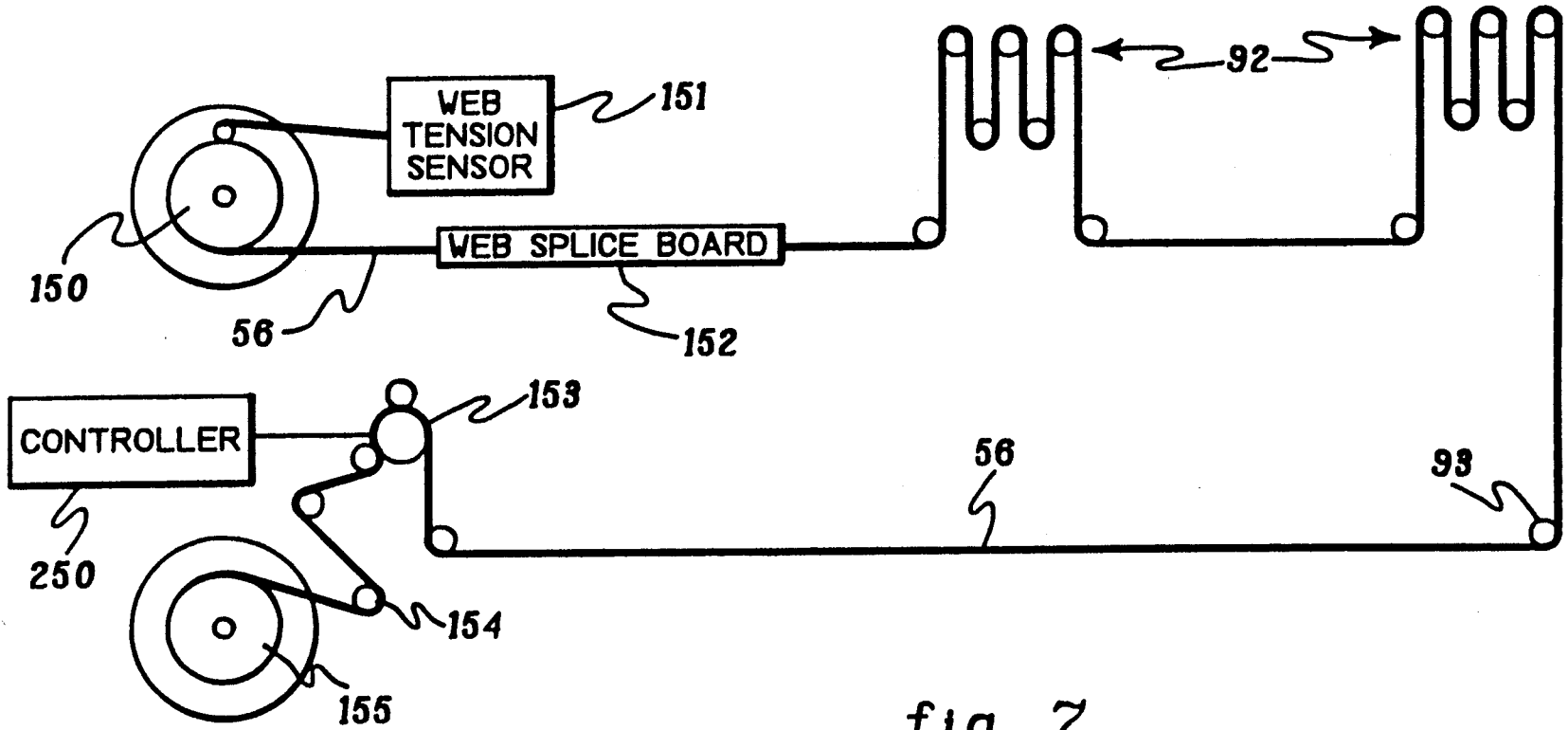
FIG. 7 is a schematic of the web transport system of the apparatus of the invention.

The transport means are commonly a system of flanged idler rolls 93 defining a path for a web 56, a feed or unwind reel for a web 150, and a take-up reel 155 for the web as shown in FIG. 7. Power is preferably applied by a main drive 153 to provide transport. The system for spreading the emulsion on the web is preferably mechanically isolated from the rest of the transport system by a series of accumulators 92 upstream and downstream of the spreader. In this fashion the rate of the web at the spreader can be more precisely controlled by a drive roller at the spreader.

Figure 8:
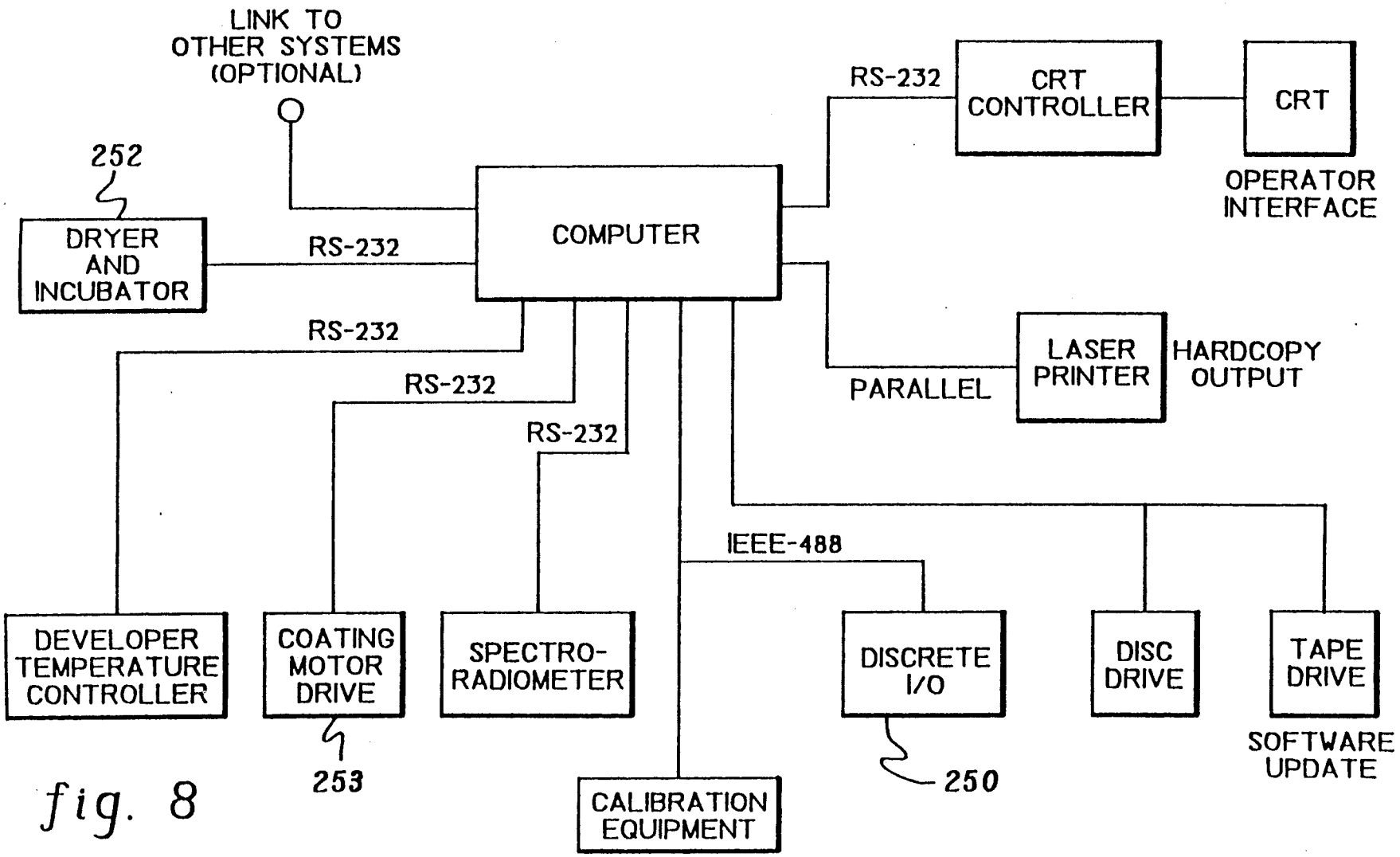
FIG. 8 is a schematic of the controlling and displaying means of the apparatus of the invention.

The control means for the processing chemistry and the transport of the web 250, the control for the chiller/drier/incubator 252 and the control for the coating drive 253 as well as the means for analyzing and displaying data are all conveniently combined in a single computer which can be programmed to control the whole operation. A schematic diagram of the control system is shown in FIG. 8.

While the foregoing description encompasses the apparatus in its basic form, modifications can be made as circumstances require. For example, if it is desired to test emulsions that will be used for high intensity exposure, a high intensity sensitometer may replace the standard sensitometer 100. Similarly, a micro-densitometer 202 can be added after the standard densitometer 102 for measuring granularity or accutance. If the emulsion being tested is coated on a web having a backscatter absorber (remjet), a remjet stripper may be interposed between the sensitometer and the developer. If the apparatus is to be used for a series of emulsions having the same developing chemistry, it may be advantageous to provide an alternate developing station which is of the traditional constant temperature bath type.

The apparatus of the invention may be used to obtain sensitometric characteristics in the usual fashion. To obtain a measure of the speed of the emulsion the output of the densitometer is compared to the exposure provided by the sensitometer, which may be displayed as density vs the log of the exposure; the intensity of exposure that produces a specified density is a measure of the speed of the emulsion. To obtain contrast, the output of the densitometer is displayed as density vs the log of the exposure. The slope of the curve is a measure of the contrast. To obtain a measure of reciprocity two exposures are made at different intensities and reciprocal exposure times (e.g. 1/10 intensity and 10× longer exposure). When the plots of density vs log of the two exposures are compared, the displacement of the curves is a measure of reciprocity. The maximum density and fog are straightforwardly obtained from the density measurements respectively of fully exposed and unexposed emulsion.

While the invention has been particularly shown and described with reference to preferred embodiments thereof, it will be understood by those skilled in the art that other changes in form and details may be made therein without departing from the spirit and scope of the invention.

We claim:

1. An apparatus for sensitometric testing of a photographic emulsion comprising:

(a) means for exposing a known image on a web coated with said emulsion;

(b) means for developing said emulsion on said web, said developing means being capable of control as to developer chemical composition, time and temperature;

(c) densitometer means for measuring the optical density of a developed, known image on said web;

(d) transport means for transporting said web coated with said emulsion from said exposing means to said densitometer means through said developing means;

(e) first control means for controlling the time, temperature and chemical composition of said developing means; and (f) second control means for regulating transport of said web from said exposing means to said densitometer means.

2. An apparatus according to claim 1 additionally comprising data analyzing means for analyzing and displaying an output of said densitometer means.

3. An apparatus according to claim 2 additionally comprising drying means interposed between said developing means and said densitometer means.

4. An apparatus according to claim 2 additionally comprising emulsion chilling, drying and incubating means and controlling means therefor, said chilling, drying and incubating means being disposed so as to feed a web coated with said emulsion to said exposing means.

5. An apparatus according to claim 4 additionally comprising drying means interposed between said developing means and said densitometer means.

6. An apparatus according to claim 4 additionally comprising emulsion spreading means and controlling means therefor, said emulsion spreading means being disposed so as to feed a web coated with said emulsion to said chilling, drying and incubating means.

7. An apparatus according to claim 6 additionally comprising drying means interposed between said developing means and said densitometer means.

8. An apparatus according to claim 6 further comprising emulsion preparing means and controlling means therefor, said emulsion preparing means being located so as to feed said emulsion to said emulsion spreading means.

9. An apparatus according to claim 8 additionally comprising drying means interposed between said developing means and said densitometer means.

10. An apparatus according to claim 1 additionally comprising drying means interposed between said developing means and said densitometer means.

11. An apparatus for sensitometric testing of a photographic emulsion comprising (a) emulsion spreading means disposed so as to feed a web coated with said emulsion to a chilling, drying and incubating means;

(b) emulsion chilling, drying and incubating means, said chilling, drying and incubating means disposed so as to feed said web coated with said emulsion to an exposing means;

(c) means for exposing a known image on said web coated with said emulsion, said exposing means being disposed so as to feed said web to a developing means;

(d) means for developing said emulsion on said web, said developing means being disposed so as to feed said web to a densitometer means;

(e) densitometer means for measuring the optical density of a developed, known image on said web;

(f) transport means for transporting said web coated with said emulsion from said emulsion spreading means to said densitometer means;

(g) first control means for controlling said chilling, drying and incubating means; and (h) second control means for regulating transport of said web from said emulsion spreading means to said densitometer means.

12. An apparatus according to claim 11 additionally comprising data analyzing means for analyzing and displaying an output of said densitometer means.

13. An apparatus according to claim 12 additionally comprising drying means interposed between said developing means and said densitometer means.

14. An apparatus according to claim 12 further comprising emulsion preparing means and controlling means therefor, said emulsion preparing means being located so as to feed said emulsion to said emulsion spreading means.

15. An apparatus according to claim 14 additionally comprising drying means interposed between said developing means and said densitometer means.

16. An apparatus according to claim 11 additionally comprising drying means interposed between said developing means and said densitometer means.

* * * * *